US005372708A

United States Patent [19]

Gewertz

[11] Patent Number: 5,372,708

[45] Date of Patent: Dec. 13, 1994

[54] METHOD FOR THE EXPLOITATION OF OIL SHALES

[75] Inventor: Moshe Gewertz, Kiryat-Yam, Israel

[73] Assignee: A.F.S.K. Electrical & Control Engineering Ltd., Kiryat-Ata, Israel

[21] Appl. No.: 3,587

[22] Filed: Jan. 13, 1993

[30] Foreign Application Priority Data

Jan. 29, 1992 [IL] Israel ..... 100798
Feb. 18, 1992 [IL] Israel ..... 101001

[51] Int. Cl.[5] ..... C10G 1/00
[52] U.S. Cl. ..... 208/434; 208/427
[58] Field of Search ..... 208/427, 434

[56] References Cited

U.S. PATENT DOCUMENTS

| | | | |
|---|---|---|---|
| 1,778,515 | 10/1930 | Hampton | 208/8 R |
| 3,661,423 | 5/1972 | Garrett | 299/2 |
| 3,972,724 | 8/1976 | Entzmann | 106/103 |
| 4,125,157 | 11/1978 | Ridley | 208/427 |
| 4,325,803 | 4/1982 | Green et al. | 208/11 LE |
| 4,536,279 | 8/1985 | Audeh | 208/434 |
| 4,599,160 | 7/1986 | Gerhold | 208/427 |
| 4,722,783 | 2/1988 | Sieg et al. | 208/411 |
| 5,008,005 | 4/1991 | Shang | 208/427 |
| 5,013,428 | 5/1991 | Christolini et al. | 208/434 |

FOREIGN PATENT DOCUMENTS 25377 3/1966 Israel .

OTHER PUBLICATIONS

Epshtein et al., "Thermal Dissolution of Baltic Combustible Shales in a Flow-Through Apparatus," *Khimiya Tverdogo Topliva,* vol. 14, No. 2, pp. 67–70 (1980).

*Primary Examiner*—Paul Lieberman
*Assistant Examiner*—Patricia Hailey
*Attorney, Agent, or Firm*—Foley & Lardner

[57] ABSTRACT

The invention relates to a process for the exploitation of oil shales wherein the two main constituents thereof, organic and inorganic moieties, are transformed into valuable products. It was found that oil shales which possess a high amount of inorganic constituents, as well as the mineral part resulted from the combustion of oil shales, have a catalytic effect on the cracking of a heavy fraction of fuel, producing valuable fractions of hydrocarbon fuel. According to the process, a mixture of oil shales which possess a low portion of organic moiety, is cracked at a temperature in the range of 350° to 600° C. with a fraction of heavy fuel having a boiling point of above 350° C. From the gases going out from the cracking reactor, hydrocarbon fuel having a boiling point of up to 350° C. is recovered. The residue resulted in said cracking is useful as a raw material in the chemical industry.

20 Claims, 2 Drawing Sheets

METHOD FOR THE EXPLOITATION OF OIL SHALES

The present invention relates to a new process for the exploitation of oil shales. More particularly, the invention relates to a new process for the utilization of the two main components of oil shales: organic constituents as well as inorganic constituents.

BACKGROUND OF THE INVENTION

The term oil shales covers a wide variety of laminated sedimentary rocks containing two main components:

(1) Organic matter, that can be released by destructive distillation, and (2) mineral constituents which consist mainly of clay, calcite, dolomite and iron compounds.

Oil shales deposits occur in many countries of the world and in sedimentary rocks of virtually all ages. These deposits vary widely as to size, constitution and strength of the shale. Broadly speaking two main categories of oil shales can be distinguished: oil shales which are rich in organic matter and contain relatively low mineral constituents, and those which are low in organic matter and rich in mineral constituents. Thus for instance, oil shales from Green River (U.S.A.) contain 22.1% CaO and a 70% conversion of organic matter to oil, whereas these from Israel contain 64.8% CaO and said conversion only 48%. On the other hand, oil shales from Iraty (Brazil) contain only 2.6% CaO and a very high conversion of the organic matter to oil. These figures clearly indicate the big differences which exist in the constituents of oil shales from various sources and their corresponding use.

Application of heat is the only means that has been found to produce oil from these shales and numerous mechanical devices known as retorts, have been developed for this purpose. Retorting involves the crushing and heating oil shales at high temperatures of about 500° C., followed by cooling and discharging of almost equally large quantities of spent shales. While this method is feasile and even applicable for oil shales which are relatively low in organic matter such as in Autumn (France), it was not considered economically to be utilized for oil shales which are low in organic matter but contain high amounts of minerals, such as in Israel.

The first recorded reference on processing oil shales is a U.K. Patent dated 1694, in which oil was distilled out from "the stone". Later on, many processes were developed based on retorting, inserting improvements for the recovery of as much as possible of the energy present in the oil shales. The main disadvantages of retorting are high-energy requirements, low conversion of the organic matter to liquid and the presence of olefins and heteroatoms in the product. Attempts were tried to obviate the energy requirements, by utilizing solvent extraction of the oil shales at ambient temperature. Using common solvents for petroleum, such as benzene, acetone, carbon disulfide, etc., only a very small amount of the organic matter could be extracted.

As known, the organic matter in oil shales is mainly an insoluble,solid material called kerogen, which has a high molecular weight being of a polymeric nature. Oil per-se is not present in oil shales, but upon its pyrolysis at about 500° C., a liquid hydrocarbon with some gaseous products and a solid residue is generated. There are some prior patents claiming the extraction of oil shales kerogen in common organic solvents at temperatures in the range of 200° C. to 400° C. Significant amounts of oils were indeed extracted at these temperatures, reaching up to 85% at 350° C. but excessive vaporization and cracking of the solvent rendered the process to be non applicable. In the U.S. Pat. No. 3,972,724 a process is described for processing fuel shales to produce energy and cement clinker. According to the process, the fuel shales are admixed with finely divided $SiO_2$, CaO and $R_2O_3$ and combusted in a steam boiler plant at a combustion temperature up to about 1400° C., generating heat and a residue from which a cement powder is produced.

The conclusion which can be reached from the prior art on this subject is that the solvent extraction based on a supercritical fluid, seems to have some advantages which appear to outweigh their disadvantages and should be considered as the most promising route for the exploitation of oil shales.

There are some references which deal particularly with the processing of oil shales which contain high amounts of mineral constituents. In a report by A. B. Vol Epshtein et al (Khimiya Tvendogo Tapliva, Vol.14, 2, 67–70, 1980), there are summarized some experiments on the thermal dissolution of Baltic combustible shales, carried out in a flow-through apparatus. The oil shales were heated for 6 to 10 hours at a temperature in the range of 400° C.–430° C. at a pressure of 30 to 50 atmospheres, in the presence of a solvent which has a boiling point in the range of 210° C. to 340° C. The ratio between the solvent to oil shales was 1.3 to 1. Under these conditions, due to a cracking reaction, occurs a degradation of the organic matter present in the oil shales which are transformed into a soluble state, obtaining a heavy oil-extract as the main product. This extract is mentioned to be useful as a power fuel, as a raw material for the production of electrode coke, as bitumen for road building and as a crude oil for obtaining hydrocarbons. The separation of the resulted liquid products is carried out by distillation. In the Israeli Patent No. 25377, there is claimed a process for the burning of low grade fuel,such as oil shales with limestone, in a suspended state at a temperature above 1000° C. in a fluidized-bed furnace. It is mentioned that at least 30% of the thermal energy required in the process, is obtained from the raw materials.

The above brief review clearly indicates the interest which is attributed to the subject of exploitation of oil shales by many scientists and especially in these days, looking for an alternative source of fuel to be produced in a most economical way.

It is an object of the present invention to provide a process for the exploitation of low grade oil shales. It is another object of the present invention to provide a process in which the two main constituents of said low grade oil shales—organic matter and mineral moiety—are efficiently utilized. It is a further object of the present invention to provide a process for the utilization the ash resulted in the processing of any oil shales, producing useful products,

BRIEF DESCRIPTION OF THE INVENTION

The invention consists in a process for the thermal dissolution of oil shales which are rich in mineral constituents (hereinafter referred to also as low-grade oil shales) and possess a low content of organic matter which comprises the steps of: (a) cracking a mixture of said oil shales with a fraction of heavy fuel having a boiling point of above 350° C. at a temperature in the range of 350° C.–600° C. and a pressure of 5 to 80 atmospheres, the ratio between said fuel fraction and oil shales being in the range of 1:0.5 and 1:5; (b) recovering from the gases going out from the cracking reactor a hydrocarbon fuel having a boiling point of up to 350° C.; and (c) the residue produced, which comprises the mineral constituents, being recovered and used as a raw material for various purposes. It was unexpectedly been found that the mineral constituent produced in the thermal decomposition of shales as well as the low-grade oil shales, possess a surprising catalytic effect on the cracking of fuel, by producing valuable fractions of hydrocarbon fuel. According to another embodiment, a crude oil or light fraction of fuel up to 350° C. is admixed with ash produced by the thermal dissolution of any oil shales producing a hydrocarbon fuel having a boiling point of up to 350° C. The process according to the present invention has the beneficial effect that imparts a most efficient utilization of the two constituents in any oil shales:

valuable fuel products from the organic matter, present in the low-grade oil shales, and a catalytic effect of the mineral moiety of oil shales.

DETAILED DESCRIPTION

Figure 1:
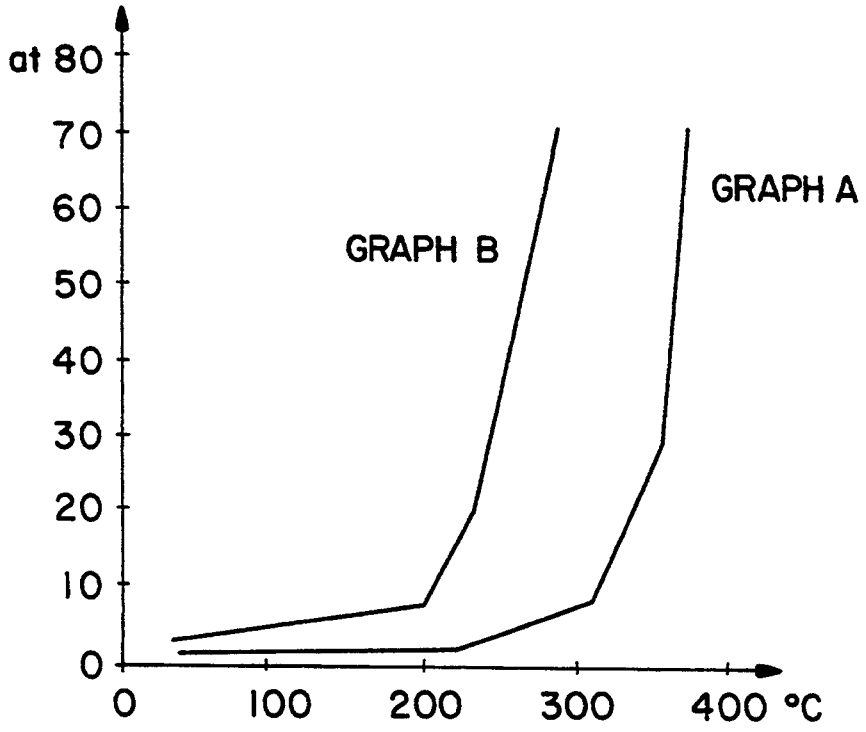
FIG. 1, illustrates the behaviour of cracking reaction of a fraction of heavy fuel alone (graph A), and the behaviour of the same fraction of heavy fuel in the presence of oil shales which are rich in mineral constituents (graph B).

From FIG. 1, it can be noticed the beneficial effect imparted to the cracking of a fraction of heavy fuel in the presence of the oil shales which are rich in mineral constituents or ash resulted from the thermal decomposition of oil shales. The physical properties of the fraction of heavy fuel used in the cracking reactions illustrated in the graphs presented FIG. 1 were as follows:

Specific gravity: 0.99 g/cc;

Viscosity: above 150 cps at 80° C. and

Boiling point (beginning) 370° C.–400° C.

Thus, in the cracking reaction of the fraction of heavy fuel alone (graph A) resulted only a small amount of products having a boiling point of up to 300° C. which raises a pressure below 10 atmospheres, compared with a significant greater amount of products which raises a pressure of about 70 atmospheres with the same fraction of heavy fuel in the presence of said oil shales (graph B).

Figure 2:
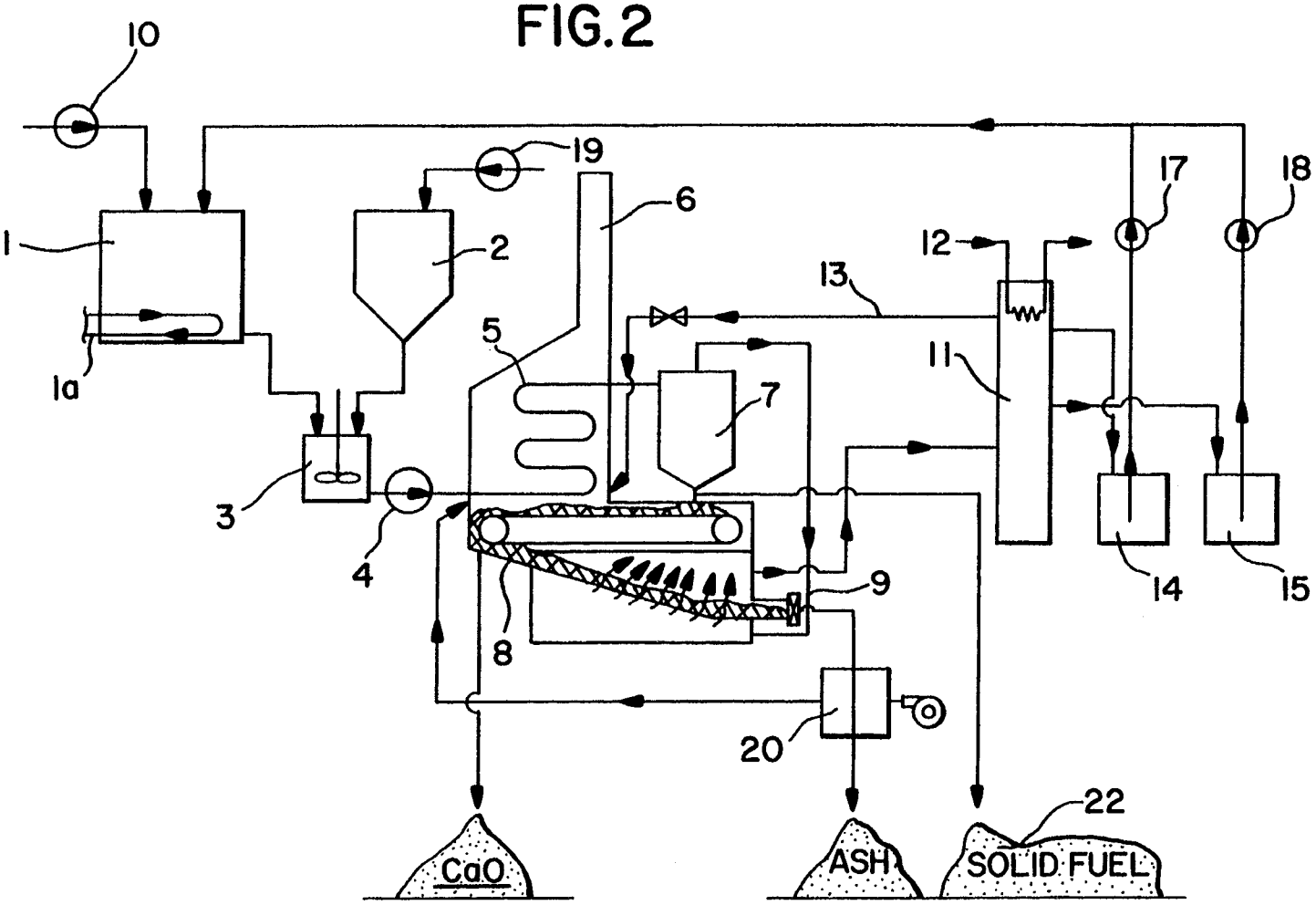
FIG. 2, is a schematic flowsheet of the process according to the present invention.

In FIG. 2, it is presented the flowsheet of the process according to the present invention which comprises the following elements:

A vessel (1) which contains the fraction of heavy fuel having a boiling point of above 350° C., being one of the lo constituents of the mixture which undergoes the cracking reaction. In case that said fraction of heavy fuel appears as a solid or as a viscous material, a heating element (1*a*) is provided in the vessel. When said fuel fraction to be used is at a temperature up to 350° C., as in the case of ash from oils shales, the heating element is only optional. The oil shales to be used, enter from the container (2) and are mixed with said fraction of fuel in the vessel (3). The homogenized slurry is conveyed through a pump (4) into a cracking reactor (5) provided with a chimney (6) o and a combustion chamber. The products resulted from the reactor are conveyed into a separator (7).

The by-product from the cracking unit comprises the solid generated from the mineral constituent of the oil shales. A major part of this solid, which contains calcium oxide is passed through a conveyor (8) situated in the cracking unit. Due to the particular active state of the calcium oxide, it will be useful to adsorb the hydrogen sulfide from the gaseous stream going out from the cracking reactor. In this manner the fuel product will be substantially-free of sulfur, a fact which has a particular advantage from an environmental point of view. This is an additional advantage of the process, since this desired operation of desulfurization is obtained without any additional reagent.

The main gaseous stream is condensed and entered into a separator (11) provided with cooling water (12), the final by-products being accumulated into the two vessels (14 and 15).

Another solid material obtained as a by-product from the separator (7), contains coke coated on the mineral constituent and is accumulated (22). This material can be used either as a substitute to the natural coal, or may be recycled in the process by its burning in the reactor (5) while the resulted hot gases will heat the mixture of oil shales and heavy fraction of fuel. In this manner a better heat recovery for the entire process is achieved. Another possible use for the solid residue, is as a raw material for the manufacture of asphalt.

Still another use for this solid residue, which is very rich in minerals is in the manufacture of cement as known from some prior references.

The cracking per-se of hydrocarbons is indeed known,being carried out in the presence of costly catalysts, which has to be regenerated after one or two stages. This is due to the fact that some coke, which is generated during the cracking, covers the surface of the catalyst until it will be deactivated. This is actually considered as one of the main reasons why in the usual cracking, only fractions of light fuel, which produce less coke, are suggested to be used. Contrary to this usual cracking, according to the present invention any fraction of heavy fuel, including even a solid residue from any refinery plant, which is liquefied by heating in the vessel (1) can be utilized with the low-grade oil shales. The main role of the heavy fuel fraction, and if required after heating, is to dissolve the organic matter from the oil shales. The weight ratio between the heavy fuel fraction to the low-grade oil shales, or light fraction of fuel to the ash and oil shales mixture, in the cracking reaction is generally in the range of between 1:0.5 to 1:5, depending on the particular products and by-products which are desired to be obtained. Thus, when more hydrocarbons and less coke are desired, this ratio should be in the range of 1:2 to 2:1.

When more coke to be used instead of coal is desired, this ratio will be preferably in the range of 2:1 to 5:1. The particles size of the oil shales which enter in the cracking reactor, depends on the desired product. In case that the main purpose is to produce fuels as a source for energy, particles size in a broad range of between 0.05 mm to 50 mm may be used. On the other hand, in case that asphaltenes are desired to be used as raw material for asphalt production, and fuels are the mainly desired products to be obtained, smaller particles size of oil shales of below 0.3 mm are to be preferred.

The pressure which will prevail in the cracking reactor is in the range of 0 to 80 atmospheres and depends on the particular fraction of fuel used in the process as well as on the desired products to be obtained. The most preferred temperature for carrying out the cracking reaction, will be in the range of between 330° C. to 570° C.

The beneficial effect imparted to the cracking of a fraction of heavy fuel by the low grade oil shales, appears clearly from the following Table 1 which summarizes some cracking experiments. The fraction of heavy fuel utilized was a residue from a viscosity breaker plant, having a specific gravity 0.99 g/cc, from the Refinery (Haifa, Israel). The weight ratio between said fuel fraction and oil shales was 2:1. A comparative experiment of cracking was carried out with the same fuel fraction but in the absence of said oils shales.

TABLE 1

| | Fuel fractions obtained by the cracking of fraction of heavy fuel alone (A) and of the same fuel fraction in the presence of low grade oil shales (B). | | | |
|---|---|---|---|---|
| | Up to 175° C. | Up to 200° C. | Up to 235° C. | Up to 350° C. |
| A: | 0 | 0 | 4% | 17% |
| B: | 20% | 25% | 30% | 57% |

The above results clearly show, that the most useful fractions of fuel, i.e. with a boiling point of up to 235° C., which result by cracking of a heavy fraction of fuel, can be obtained only in the presence of low grade oil shales. In the absence of said oil shales, only a small fraction with a very high boiling point was obtained.

The process according to the present invention is characterized by its versatility, whereby the products which could be obtained from the separator and the resulted by-products, can be obtained by adjusting the reaction conditions and the ratio between the components. High pressure of above 20 atmospheres or ratio of 2:1 fuel to oil shales, will produce more asphaltenes to be used for the manufacture of asphalt. On the other hand, when more calcium oxide is desired to be used as a filler or as a desulfurizing agent, a low pressure of about 5 atmospheres will be used. In case that the object of the process is to utilize a maximum amount of oil shales and to recover the organic matter as fuel, or as raw material for producing chemicals, the heavy fractions (boiling point above 350° C.) will be recovered, while the lighter fractions (boiling point below 350° C.) can be recycled to the cracking reactor as a solvent of the organic matter present in the oil shales.

Another embodiment according to the present invention, is to utilize the ash produced in the combustion of oil shales, with oil shales and a light fraction of a fuel having a boiling point of up to 350° C. It was found that said ash has the same catalytic effect on the cracking of an oil as the mineral constituent of oil shales. When using this embodiment, there is an important advantage which enables to regulation of the ratio between the mineral constituents and the organic matter entering into the cracking reactor, thus obtaining the desired product. This has a particular advantage in the places where the oil shales are rich in organic matter and low in mineral constituents. Generally the ratio between the ash and oil shales will be in the range of between 1:0.95 to about 0.05:0.95 depending on the type of oil shales which are available at site.

Typical examples of the fuel fractions up to 350° C. to be used with the ash in the cracking reaction are: diesel oil, gas-oil, kerosine, etc.

The beneficial effect imparted to the cracking reaction of a crude oil (64% by weight) by a mixture of oil shales (29%) and ash (6.8%) appears from the Table 1 below for the mixture (B). The ash used in the cracking experiment, had the following composition (weight percentage):

| | | | | | |
|---|---|---|---|---|---|
| CaO | 50% | MgO | 0.63% | $Al_2O_3$ | 6.8% |
| $K_2O$ | 0.43% | $SO_3$ | 9% | $Fe_2O_3$ | 3.5% |
| $Na_2O$ | 0.56% | $SiO_2$ | 17.4% | $P_2O_5$ | 2.3% |
| C (organic) below 0.1%. | | | | | |

The crude oil used in the cracking reaction had a viscosity of 92 centistokes at 20° C. and specific gravity of 0.90. A comparative experiment For this cracking, under the same conditions, was carried out using the crude oil alone (A).

While the invention will be hereinafter illustrated by some specific Examples, it should be understood that these Examples are presented only for a better understanding of the invention, without limiting its scope. A person skilled in the art, after reading the present specification will be in a position to insert some modifications, without being outside the invention as covered by the appended Examples.

The concentrations mentioned the Examples are by weight percentage.

EXAMPLE 1

The following reagents were introduced into a retort: 50.8 g of oil shales, containing 64.8% calcium oxide and about 10% organic matter, and 81 g of a heavy fuel residue, 75% thereof having a boiling point of above 375° C. The retort was heated for about 60 minutes at a temperature of 420° C. The pressure in the autoclave was about 55 atmospheres. The following fuel fractions were obtained:

Up to 200° C.: 25%.
Up to 350° C.: 60%.
Up to 375° C.: 70% and
Above 375° C.: 30%.

EXAMPLE 2

An amount of 40 g of the oil shales, as in Example 1, was mixed with 82 g of a fuel residue, 50% thereof having a boiling point of above 350° C. The mixture was introduced into a retort and heated at 385° C. for about 70 minutes. The pressure in the retort was about 63 atmospheres.

The following fuel fractions were obtained:

Up to 150° C.: 8%.
Up to 230° C.: 18%.
Up to 310° C.: 40% and
Above 310° C.: 60%.

EXAMPLE 3

An amount of 101.7 g of the oil shales as in the previous Examples, was mixed with 190 g of the same fuel residue as in Example 2. The mixture was introduced into a retort and heated at 400° C. for about 75 min. The pressure in the retort was about 40 atmospheres. The resulted product consisted of: 9.2% of fuel which could replace the common diesel oil, 50.8% of gas oil and 11.9% of petrol coke.

EXAMPLE 4

An amount of 22 g of ash, resulted after the combustion of oil shales having the composition as given above, was mixed with 93 g of low grade oil shales (10% organic matter and 64.8% calcium oxide). The mixture was introduced into a cracking reactor containing 205 g of crude oil having a density of 0.9 g/cc at 20° C.

The cracking reaction was carried out at a temperature of 467° C. for 60 minutes, the pressure being 15 atmospheres.

The products resulted at the end of the reaction were as follows:

112.0 g of liquid hydrocarbons;
9.4 g of water;
134 g of solid minerals;
32 g of coke; and
32.6 g of gases.

The following fractions were obtained from the resulted liquid hydrocarbons (temperatures in degrees C):

| Up to 120 | Up to 180 | Up to 250 | Up to 300 | Up to 350 | Above |
|---|---|---|---|---|---|
| 25% | 43.4% | 20.3% | 6.7% | 3.4% | 1.2% |

EXAMPLE 5

An amount of 110.3 g of a mixture of low grade oil shales (as in Example 1) and 5 g of ash (having the composition as given above) was introduced into a cracking reactor containing 199 g of crude oil having a density of 0.89 g/cc at 20° C.

The cracking reaction was carried out at a temperature of 495° C. for 60 minutes, the pressure in the reactor being 15 atmospheres.

The resulted products at the end of the reaction were as follows:

100.72 g of liquid hydrocarbons.
16.19 g of water.
94 g of solid minerals.
40.7 g of coke, and
57.52 g of gases.

The following fractions were obtained from said liquid hydrocarbons (temperatures are given in degrees Celsius):

| Up to 120 | Up to 180 | Up to 250 | Up to 300 | Up to 350 | Above |
|---|---|---|---|---|---|
| 19.4% | 42.1% | 27.6% | 6.2% | 2.5% | 2.2% |

I claim:

1. A process for the utilization of the organic and mineral constituents present in oil shales by a thermal dissolution of organic matter, which comprises the steps of:

(a) cracking a mixture of oil shales low in organic constituents, with a fraction of heavy fuel having a boiling point of above 350° C., at a temperature in the range of 350° C. to 600° C. and a pressure in the range of 5 to 80 atmospheres, the weight ratio between said fuel fraction and oil shales being in the range of between 1:0.5 and 1:5;

(b) recovering from the gases emanating from the cracking step (a) a hydrocarbon fuel having a boiling point of up to 350° C., and (c) utilizing the resulting residue containing the mineral constituents as a raw material in the chemical industry.

2. The process according to claim 1, wherein said oil shales have a catalytic effect on the cracking of the fraction of heavy fuel.

3. The process according to claim 1, wherein the temperature during the cracking reaction is in the range of 370° C. to 500° C.

4. The process according to claim 1, wherein the fraction of heavy fuel dissolves the organic matter present in the oil shales.

5. The process according to claim 1, wherein the particles size of the oil shales is in the range of between 0.05 to 50 mm.

6. The process according to claim 1, wherein the fractions of heavy fuel resulted in the process, are recycled to the cracking reaction to dissolve the organic matter present in the oil shales, being decomposed into light fractions.

7. The process according to claim 1, wherein active calcium oxide is produced by the thermal decomposition of calcium carbonate present in the mineral constituents of the oil shales.

8. The process according to claim 7, wherein said calcium oxide is utilized for the desulfurization of the resulted gases going out from the cracking reactor.

9. The process according to claim 1, wherein the gases going out from the cracking reactor are used to heat the mixture of oil shales and heavy fuel fraction.

10. The process according to claim 1, wherein the weight ratio between the fraction of heavy fuel to the oil shales is in the range of 0.5:1 to 2:1.

11. The process according to claim 1, wherein the weight ratio between the fraction of heavy fuel to the oil shales is in the range of 1:1.5 to 1:5.

12. The process according to claim 1, wherein the residue contains coke coated on the mineral constituents.

13. The process according to claim 12, wherein said coke is burned in the cracking unit.

14. The process according to claim 1, wherein the residue contains asphaltenes to be used for the manufacture of asphalt.

15. A process for the recovery of the valuable constituents present in the ash resulting from the combustion of oil shales, which comprises the steps of:

(a) cracking a substantially water-free oil selected from crude oil and light fractions of fuel having a boiling point of up to 350° C. in the presence of a mixture of oil shales and said ash at a temperature in the range of 300° C. to 600° C. and a pressure of 0 to 80 atmospheres, the weight ratio between said oil and said mixture being in the range of between 1:0.5 to 1:5;

(b) recovering from the gases emanating from the cracking step (a) a hydrocarbon fuel having a boiling point of up to 350° C. and (c) utilizing the residue produced, which comprises the mineral constituents as a material for various purposes.

16. The process according to claim 15, wherein said ash has a catalytic effect on the cracking of said water-free oil.

17. The process according to claim 16, wherein said water-free oil has a density in the range of between 0.73 to 1.08 g/cc at 20° C.

18. The process according to claim 17, wherein said water-free oil is selected from the group consisting of diesel oil, gas oil and kerosene.

19. The process according to claim 15, wherein the weight ratio between said water-free oil and the mixture of oil shales and ash is in the range of between 0.5:1 to 2:1.

20. The process according to claim 19, wherein the weight ratio between the ash and oil shales is in the range of between 1:1.5 to 1:5.

* * * * *